US010479628B2

(12) United States Patent
Uchino

(10) Patent No.: US 10,479,628 B2
(45) Date of Patent: Nov. 19, 2019

(54) SHEET CONVEYING DEVICE AND IMAGE RECORDING APPARATUS PROVIDED WITH THE SAME

(71) Applicant: Brother Kogyo Kabushiki Kaisha, Nagoya-shi, Aichi-ken (JP)

(72) Inventor: Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/018,302

(22) Filed: Jun. 26, 2018

(65) Prior Publication Data

US 2019/0002222 A1 Jan. 3, 2019

(30) Foreign Application Priority Data

Jun. 30, 2017 (JP) ..... 2017-129544

(51) Int. Cl.
*B65H 5/06* (2006.01)
*B65H 3/06* (2006.01)

(52) U.S. Cl.
CPC ..... *B65H 5/06* (2013.01); *B65H 3/0669* (2013.01); *B65H 3/0684* (2013.01); *B65H 5/062* (2013.01); *B65H 2402/30* (2013.01); *B65H 2402/40* (2013.01); *B65H 2402/42* (2013.01); *B65H 2402/522* (2013.01); *B65H 2601/122* (2013.01); *B65H 2801/12* (2013.01)

(58) Field of Classification Search
CPC ..... B65H 5/06; B65H 5/062; B65H 29/125; B65H 2402/34; B65H 2402/40; B65H 2402/43; B65H 2403/42; B65H 2404/16; B65H 2515/82; F16H 55/18; F16H 55/24; F16H 57/12; F16H 2057/125; F16H 2057/0225; F16H 1/12; F16H 55/0846
USPC ..... 271/272, 264, 314; 74/409, 396, 416
See application file for complete search history.

(56) References Cited

U.S. PATENT DOCUMENTS 8,789,829 B2 7/2014 Kawamata
2009/0243209 A1* 10/2009 Samoto ..... B65H 1/266 271/273
2013/0228966 A1 9/2013 Kawamata
2014/0232059 A1* 8/2014 Mimoto ..... B65H 3/0684 271/117

(Continued)

FOREIGN PATENT DOCUMENTS

JP H10-42513 A 2/1998
JP 2013-180468 A 9/2013

*Primary Examiner* — David H Bollinger
(74) *Attorney, Agent, or Firm* — Banner & Witcoff, Ltd.

(57) ABSTRACT

A sheet conveying device includes a motor, a first gear, a roller, a second gear, a first frame and a second frame. The first gear is attached to the motor. The second gear is attached to the roller, and in meshing engagement with the first gear. The first frame includes a wall having a side surface. The second frame is provided with: a first abutment portion in abutment with the side surface; and a second abutment portion in abutment with the side surface. The second abutment portion is positioned downstream of the first abutment portion in a second direction that is perpendicular to an axial direction of the roller. An abutment position between the second abutment portion and the side surface is positioned downstream in a first direction along the axial direction of the roller of an abutment position between the first abutment portion and the side surface.

14 Claims, 10 Drawing Sheets

(56) References Cited

U.S. PATENT DOCUMENTS

| | | | | |
|---|---|---|---|---|
| 2016/0090252 | A1* | 3/2016 | Iijima | B41J 29/02 |
| 2018/0115677 | A1* | 4/2018 | Tamura | B65H 5/06 |

* cited by examiner

SHEET CONVEYING DEVICE AND IMAGE RECORDING APPARATUS PROVIDED WITH THE SAME

CROSS REFERENCE TO RELATED APPLICATION

This application claims priority from Japanese Patent Application No. 2017-129544 filed Jun. 30, 2017. The entire content of the priority application is incorporated herein by reference.

TECHNICAL FIELD

The present disclosure relates to a sheet conveying device for conveying a sheet, and an image recording apparatus provided with the sheet conveying device.

BACKGROUND

United States Patent Application Publication No. 2013/0228966A1 discloses a sheet conveying device including a roller for conveying a sheet upon rotation, and a motor for imparting driving force to the roller. Power transmission from the motor to the roller is performed by using a belt.

SUMMARY

Desirably, power transmission from the motor to the roller should be performed without employment of an intervening component such as the belt in order to enhance conveying accuracy of the sheet. For example, direct power transmission from the motor to the roller may be conceivable by meshing engagement between a gear coupled to the motor and a gear coupled to the roller.

However, even in the case of power transmission employing the gears, the backlash amount between the gears may shift from its optimum value due to dimensional tolerance and geometric tolerance of the gears and components associated therewith such as the motor, the roller, a frame supporting the motor, and a bearing supporting the roller.

In view of the foregoing, it is an object of the disclosure to provide a conveying device and an image recording apparatus provided with the conveying device capable of reducing the deviation of the backlash amount between the gears from the optimum value in a structure where meshing engagement of the gears are employed for the power transmission from the motor to the roller.

In order to attain the above and other objects, according to one aspect, the disclosure provides a conveying device including a motor, a first gear, a roller, a second gear, a first frame, and a second frame. The first gear is attached to the motor such that the first gear is rotatable together with the motor and coaxially with the motor. The roller is configured to be rotated to convey a sheet. The roller extends in an axial direction. The second gear is attached to the roller such that the second gear is rotatable together with the roller and coaxially with the roller. The second gear is in meshing engagement with the first gear. The first frame supports the motor. The second frame extends in the axial direction of the roller. The first frame includes a wall having a side surface in confrontation with the second frame in the axial direction of the roller. The wall of the first frame is disposed downstream of the second frame in a first direction along the axial direction of the roller. An axis of the roller is located upstream of an axis of the motor in a second direction that is perpendicular to the axial direction of the roller. The second frame is provided with a first abutment portion positioned upstream of the wall of the first frame in the first direction and in abutment with the side surface of the wall, and a second abutment portion positioned upstream of the wall of the first frame in the first direction and in abutment with the side surface of the wall. The second abutment portion is positioned downstream of the first abutment portion in the second direction. An abutment position between the second abutment portion and the side surface of the wall of the first frame is positioned downstream in the first direction of an abutment position between the first abutment portion and the side surface of the wall of the first frame.

According to another aspect, the disclosure provides an image recording apparatus including the sheet conveying device described above and a recording device. The recording device is configured to record an image on the sheet conveyed by the roller of the sheet conveying device.

BRIEF DESCRIPTION OF THE DRAWINGS

The particular features and advantages of the embodiment as well as other objects will become apparent from the following description taken in connection with the accompanying drawings, in which.

DETAILED DESCRIPTION

Figure 1:
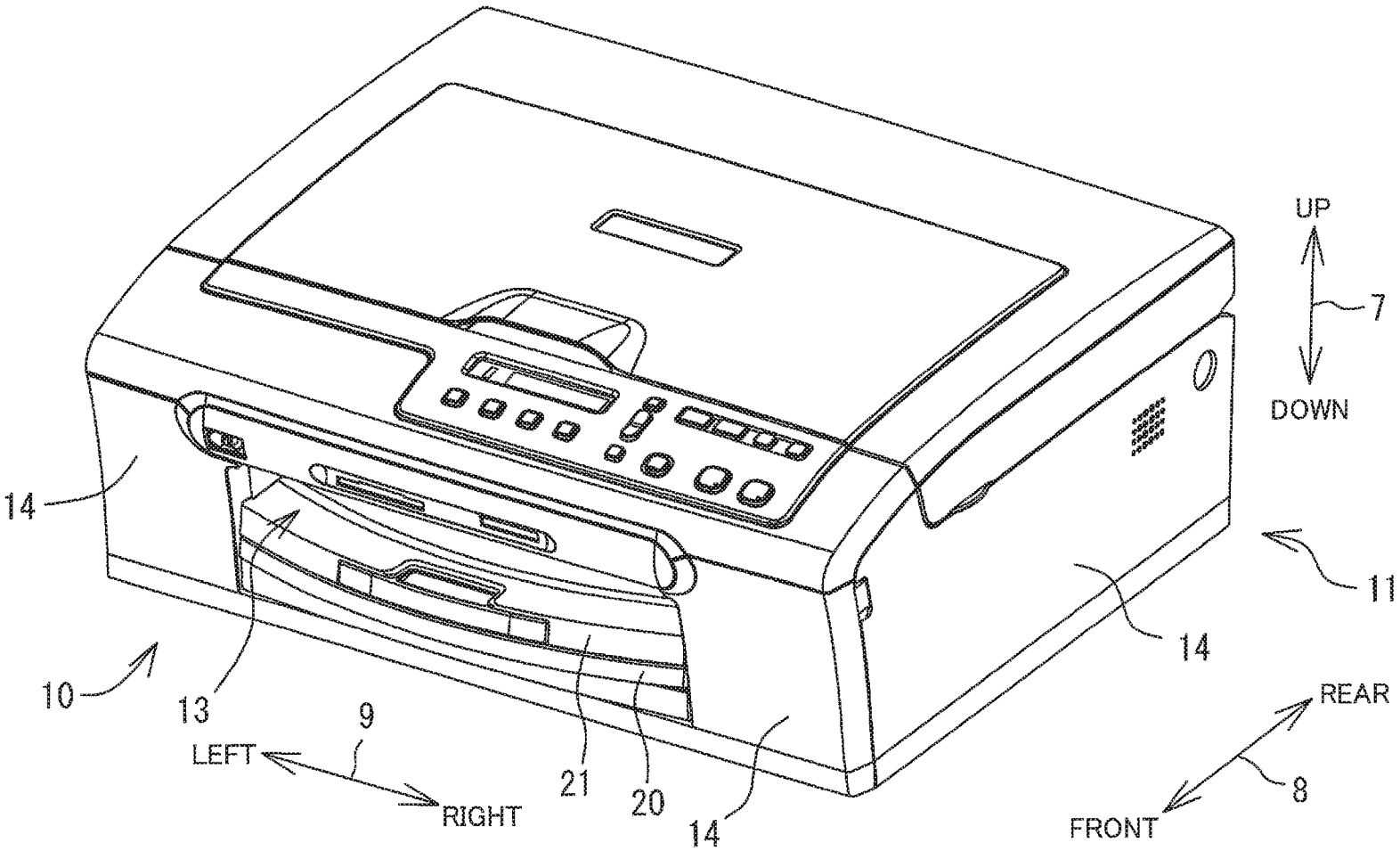
FIG. 1 is a perspective view illustrating a multi-function apparatus 10 as an example of an image recording apparatus according to the disclosure.

A multi-function apparatus 10 according to one embodiment will be described with reference to FIGS. 1 through 8 and 10A and 10B. In the following description, the upward/downward direction 7 is defined when the multi-function apparatus 10 is disposed in an orientation in which the multi-function apparatus 10 is intended to be used as illustrated in FIG. 1. A surface having an opening 13 will be referred to as a front surface to thus define frontward/rearward direction 8. The leftward/rightward direction 9 is defined when viewing the multi-function apparatus 10 from a front.

[Overall Structure of Multifunction Apparatus 10]

Figure 2:
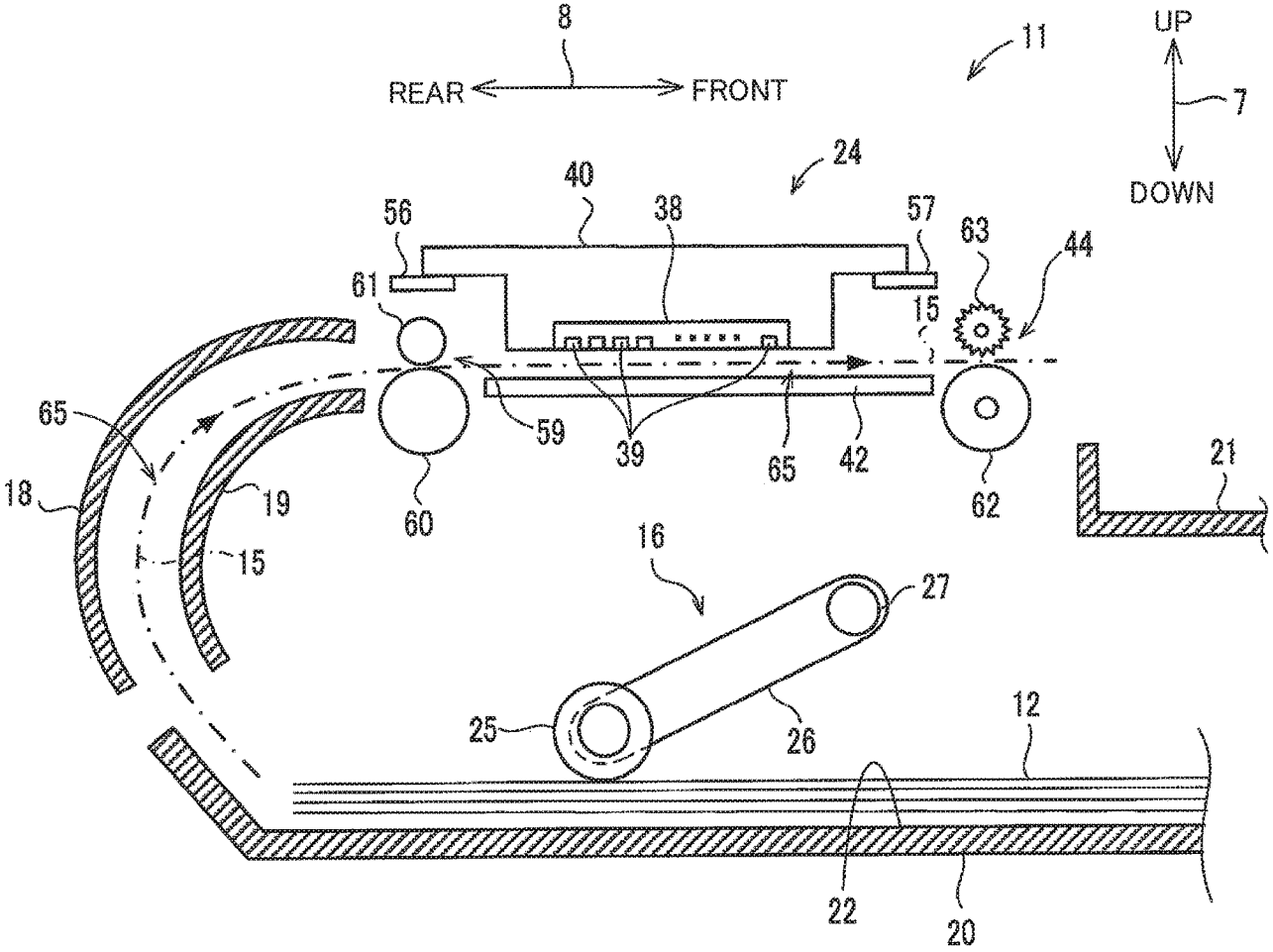
FIG. 2 is a schematic vertical cross-sectional view illustrating an internal structure of a printer portion 11 of the multi-function apparatus 10.

As illustrated in FIG. 1, the multifunction apparatus 10 is generally parallelepiped in shape, and has a lower portion provided with a printer portion 11 (as an example of an image recording apparatus). The printer portion 11 includes an ink jet recording system to form an image on a sheet 12 (FIG. 2). The multifunction apparatus 10 has various functions such as facsimile function and printing function.

As illustrated in FIG. 2, the printer portion 11 includes a recording portion 24, a platen 42, and a conveying device. The conveying device includes a sheet supply tray 20, a discharge tray 21, a sheet supply portion 16, a sheet supply motor (not illustrated), a conveyer motor 80 (as an example of a motor, FIG. 5), a first gear 81 (FIG. 4), a conveying roller pair 59, a second gear 82 (see FIG. 4), a discharging roller pair 44, a pair of side frames 55 (FIG. 3), a guide rail 56 (as an example of a second frame, FIG. 4), a guide rail 57, a motor support frame 90 (as an example of a first frame, FIG. 7), and a rotary encoder 83 (FIG. 6).

[Sheet Supply Tray 20]

As illustrated in FIG. 1, the front surface of the printer portion 11 has the opening 13 through which the sheet supply tray 20 is inserted into or removed from the printer portion 11. The sheet supply tray 20 is box shaped with its upper side being open. As illustrated in FIG. 2, the sheet supply tray 20 has a bottom plate 22 on which sheets 12 of various sizes can be supported.

[Discharge Tray 21]

As illustrated in FIG. 1, the discharge tray 21 is positioned above the sheet supply tray 20, and is adapted to support a sheet 12 printed by the recording portion 24 and discharged therefrom.

[Sheet Supply Portion 16]

As illustrated in FIG. 2, the sheet supply portion 16 is positioned above the bottom plate 22 of the sheet supply tray 20 inserted into the printer portion 11. The sheet supply portion 16 includes a pick-up roller 25, a pick-up arm 26, and a shaft 27.

The pick-up roller 25 is rotatably supported to a free end portion of the pick-up arm 26. The pick-up roller 25 is rotated upon receiving driving force from the sheet supply motor (not illustrated). The printer portion 11 includes a base frame (not illustrated) constituting a lower portion of the printer portion 11 and an outer cover 14 (FIG. 1) attached to the base frame. The shaft 27 is supported to the base frame, and a base end portion of the pick-up arm 26 is pivotally movably supported to the shaft 27. The pick-up arm 26 is pivotally movably urged toward the bottom plate 22 by its own weight or a resilient force applied by a spring (not illustrated). The pick-up roller 25 is configured to be rotated while being in contact with the sheet 12 supported on the bottom plate 22. Thus, the pick-up roller 25 picks up an uppermost sheet on the bottom plate 22 to supply the sheet toward a conveying passage 65 described below.

[Conveying Passage 65]

As illustrated in FIG. 2, the conveying passage 65 is positioned inside the printer portion 11 and is defined by an outer guide member 18 and an inner guide member 19 in confrontation with the outer guide member 18 by a predetermined interval. The conveying passage 65 extends rearward from a rear end portion of the sheet supply tray 20 and is curved upward and frontward at a rear portion of the printer portion 11 to reach the discharge tray 21. The conveying passage 65 passes through a nipping position of the conveying roller pair 59, a position between the recording portion 24 and the platen 42, and a nipping position of the discharging roller pair 44. A sheet conveying direction in the conveying passage 65 is indicated by a single dot-dashed line 15 in FIG. 2.

[Conveying Roller Pair 59 and Discharging Roller Pair 44]

As illustrated in FIG. 2, the conveying roller pair 59 is positioned at the conveying passage 65, and includes a conveying roller 60 (as an example of a roller), and a pinch roller 61. The discharging roller pair 44 is positioned downstream of the conveying roller pair 59 in the sheet conveying direction 15, and includes a discharge roller 62 and a spur 63.

Figure 4:
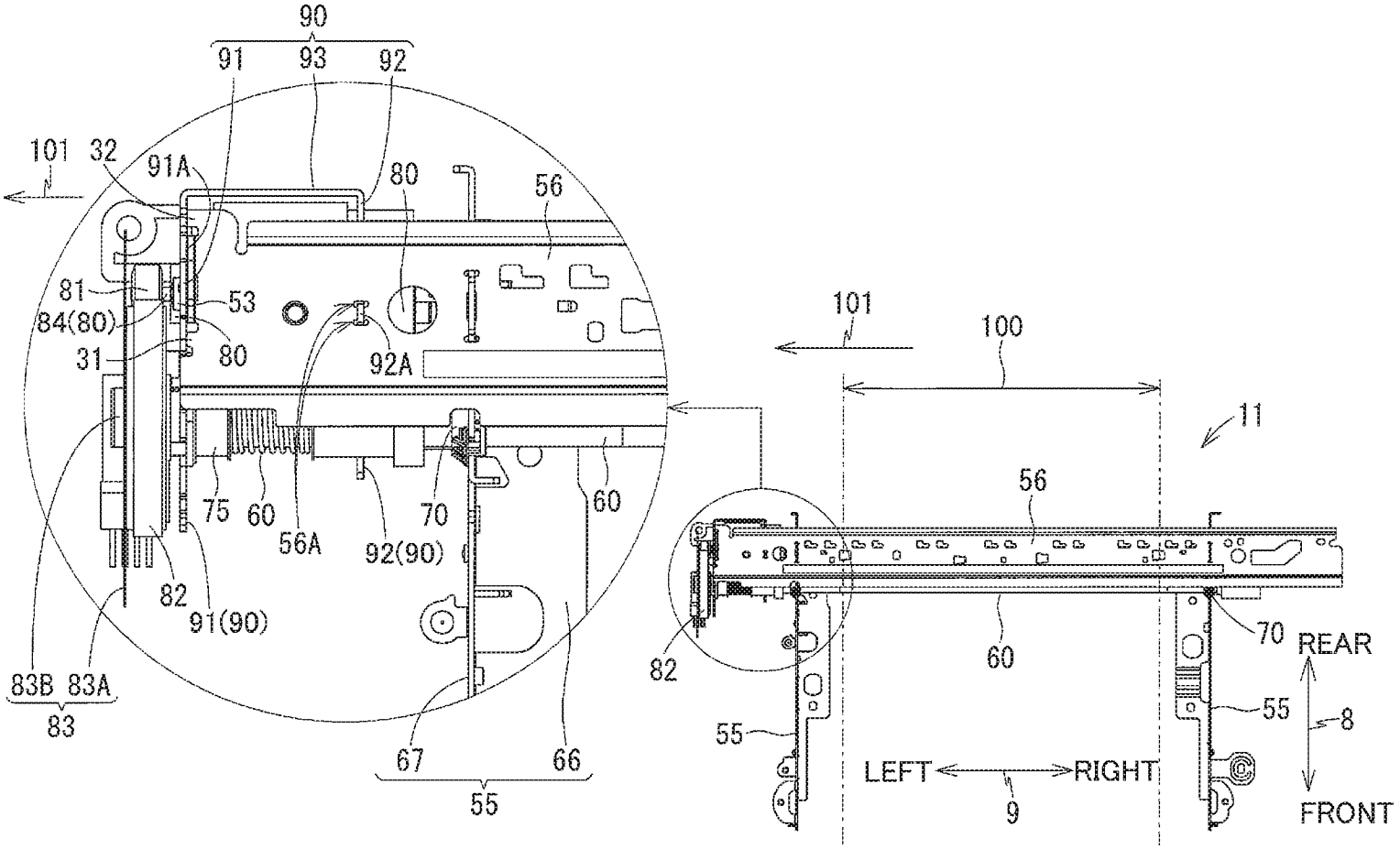
FIG. 4 is a plan view illustrating the side frames 55, the guide rail 56, the conveying roller 60, a conveyer motor 80, a first gear 81, the second gear 82, and a motor support frame 90, those being components of the printer portion 11.

The conveying roller 60 and the pinch roller 61 are in rolling contact with each other. Further, the discharge roller 62 and the spur 63 are in abutment with each other. The conveying roller 60 is rotated by a driving force transmitted from the conveyer motor 80 (FIG. 5) through the first gear 81 (FIG. 4) and the second gear 82 (FIG. 4). The discharge roller 62 is drivingly connected to the conveying roller 60 by an endless belt (not illustrated). Thus, the discharge roller 62 is rotated by the driving force from the conveying roller 60. The conveying roller pair 59 and the discharging roller pair 44 nip the sheet 12 and convey the sheet 12 in the sheet conveying direction 15.

The conveying roller 60, the pinch roller 61, the discharge roller 62, and the spur 63 are rotated about their axes extending in the leftward/rightward direction 9 which is an example of an axial direction of the conveying roller. The conveyer motor 80 is rotated about its axis that is on the horizontal plane, but is slightly inclined from the leftward/rightward direction 9.

[First Gear 81 and Second Gear 82]

Figure 5:
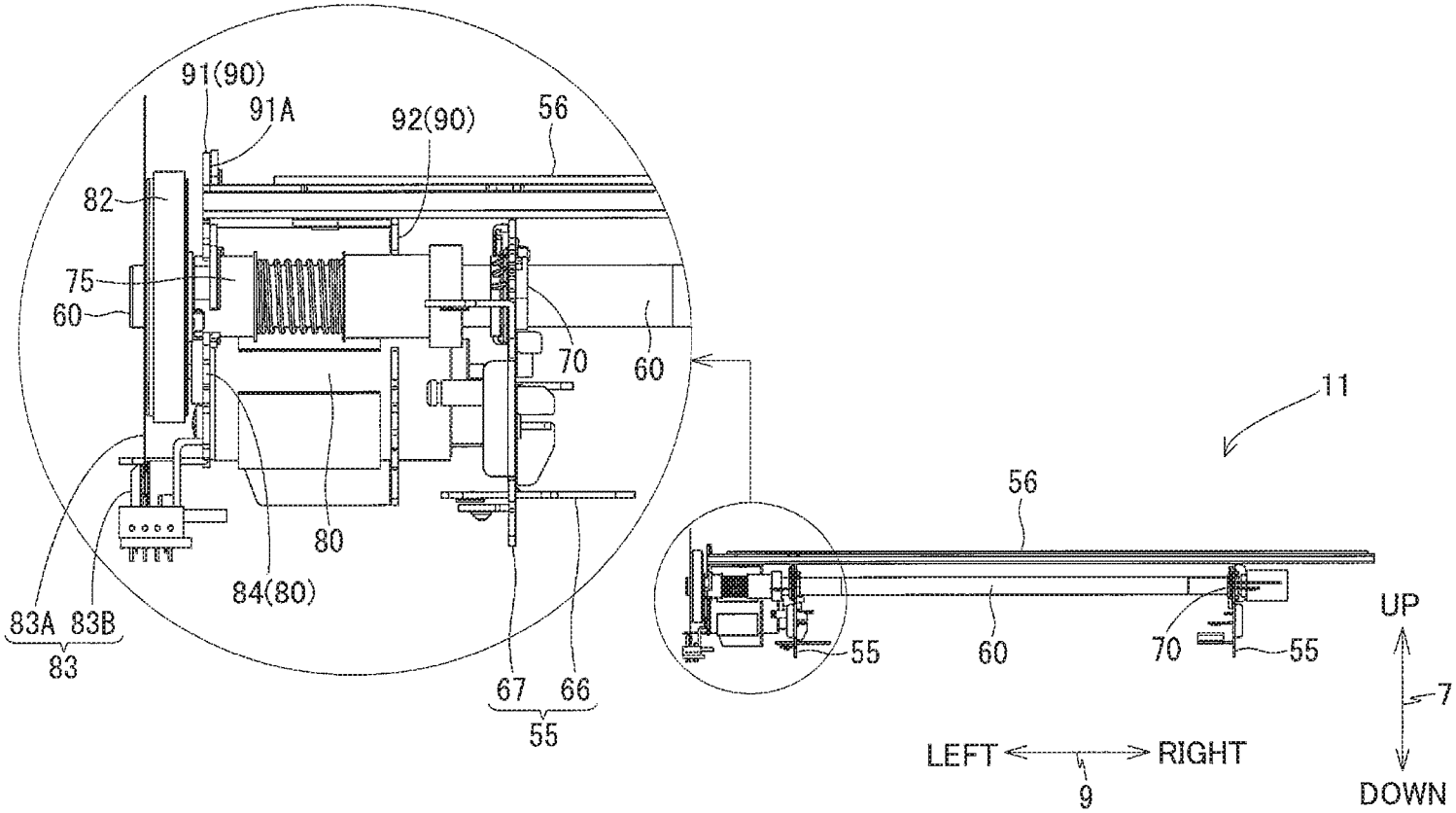
FIG. 5 is a front view illustrating the side frames 55, the guide rail 56, the conveying roller 60, the conveyer motor 80, the second gear 82, and the motor support frame 90, those being components of the printer portion 11.
Figure 6:
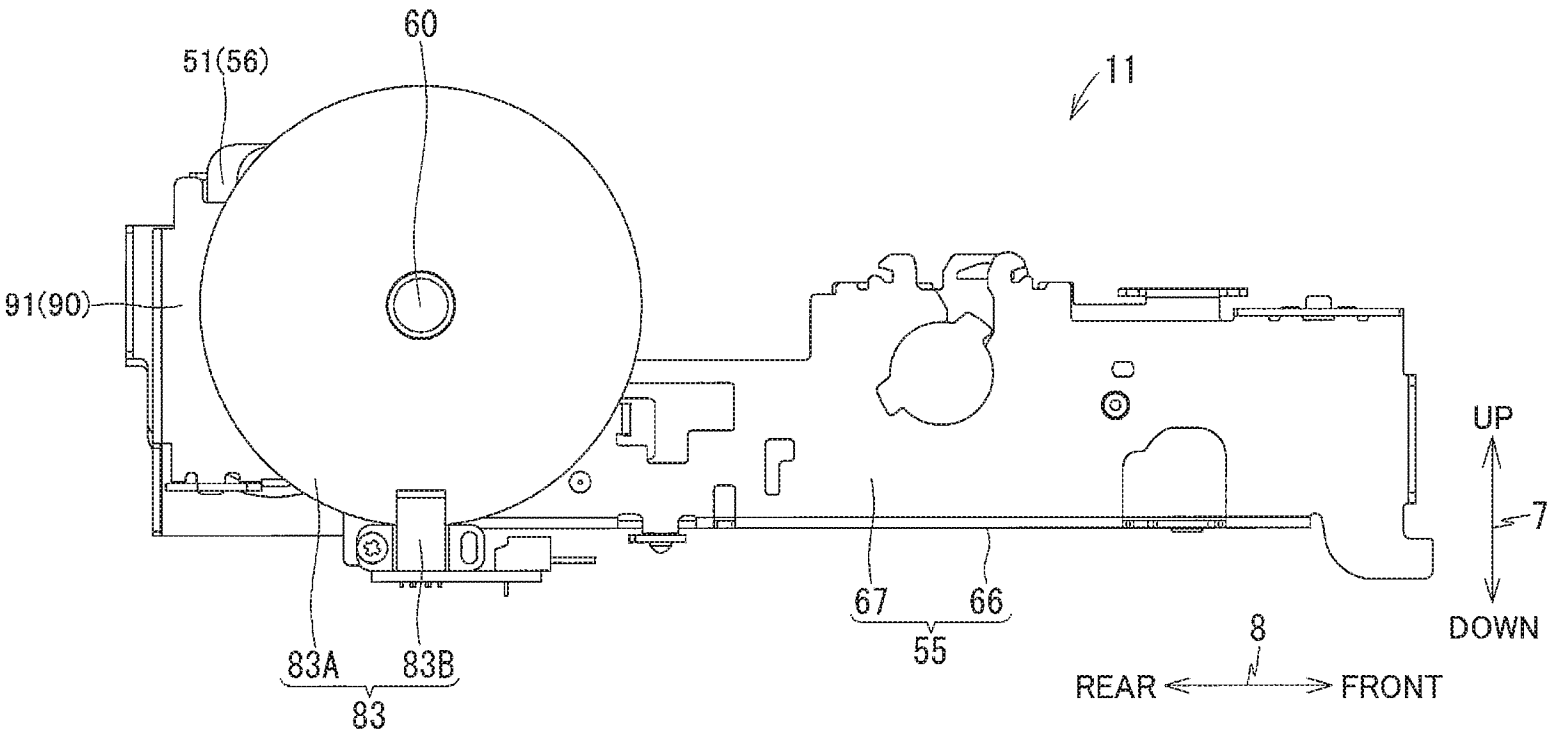
FIG. 6 is a left side view illustrating the components illustrated in FIG. 4.

As illustrated in FIG. 5, the conveyer motor 80 has a motor body and a shaft 84 extending leftward from the motor body. As illustrated in FIG. 4, the first gear 81 is attached to a tip end portion (left end portion) of the shaft 84 such that the first gear 81 is rotatable about an axis of the shaft 84. In other words, the first gear 81 is attached to the conveyer motor 80 such that the first gear 81 is rotatable integrally and coaxially with the conveyer motor 80.

As illustrated in FIG. 4, the second gear 82 is attached to a left end portion of the conveying roller 60 such that the second gear 82 is rotatable about an axis of the conveying roller 60. The second gear 82 is rotatable integrally and coaxially with the conveying roller 60. The second gear 82 is in meshing engagement with the first gear 81. Thus, driving force of the conveyer motor 80 is transmitted to the conveying roller 60 through the first gear 81 and the second gear 82.

As will be described later with reference to FIG. 7, the shaft 84 of the motor 80 is disposed at a position rearward and downward of the conveying roller 60. The conveying roller 60 extends in the leftward/rightward direction 9. On the other hand, the shaft 84 of the motor 80 extends substantially in the leftward/rightward direction 9, but is slightly inclined relative to the leftward/rightward direction 9. More specifically, the shaft 84 of the motor 80 extends on the horizontal plane, with the left end portion (tip end portion) of the shaft 84 being positioned slightly frontward relative to the right end portion (base end portion) of the shaft 84, as a result of which the pitch between the first gear 81 and the second gear 82 is slightly narrowed. It is noted that the pitch between the first gear 81 and the second gear 82 is defined as a distance between the center of the first gear 81 and the center of the second gear 82.

It is noted that when the backlash amount between the first gear 81 and the second gear 82 is set to an optimum value, the conveying roller 60 is capable of conveying sheets in an optimum state, that is, with high accuracy and in a silent manner. Contrarily, when the backlash amount is too large relative to the optimum amount, the conveying roller 60 is unable to convey sheets with high accuracy. On the other hand, when the backlash amount is too small relative to the optimum amount, an excessive load is imparted on the first and second gears 81, 82 and abnormal sound is generated during rotation of the first and second gears 81, 82.

The backlash amount between the first gear 81 and the second gear 82 varies in accordance with a change in the pitch between the first gear 81 and the second gear 82. That is, the backlash amount increases as the pitch increases. The backlash amount decreases as the pitch decreases. The backlash amount between the first gear 81 and the second gear 82 can therefore be adjusted by adjusting the pitch between the first gear 81 and the second gear 82.

[Rotary Encoder 83]

As illustrated in FIG. 6, the rotary encoder 83 includes an encoder disc 83A and an optical sensor 83B. The encoder disc 83A is attached to the conveying roller 60 such that the encoder disc 83A is rotatable integrally with and coaxially with the conveying roller 60. The encoder disc 83A has light transmitting portions and light shielding portions alternately arrayed with a constant interval in a circumferential direction of the encoder disc 83A. The optical sensor 83B is adapted to optically detect the encoder disc 83A and output to a controller (not illustrated) of the multifunction apparatus 10 electric signals which are pulse signals indicative of changes in light transmission and light interruption in accordance with the rotation of the encoder disc 83A. The controller is adapted to compute rotation speed and rotation amount of the conveying roller 60 on a basis of output from the optical sensor 83B. That is, the rotary encoder 83 is adapted to output pulse signals indicative of the rotation amount of the conveying roller 60.

The backlash amount between the first gear 81 and the second gear 82 can be represented by a rotation amount (angular amount) of a gear tooth of the second gear 82 immediately after stopping rotation of a gear tooth of the first gear 81. Specifically, the backlash allows the second gear 82 to rotate by inertia, even if the first gear 81 stops. The rotation of the second gear 82 is stopped upon abutment of the gear tooth of the second gear 82 against the gear tooth of the first gear 81. Accordingly, the rotary encoder 83 can be used to detect the backlash amount between the first gear 81 and the second gear 82 as the rotation amount of the encoder disc 83A. More specifically, the backlash amount between the first gear 81 and the second gear 82 can be detected as the number of pulse signals [enc] that have been outputted from the rotary encoder 83 during a period after the first gear 81 stopped rotating and until the second gear 82 finally stops rotating.

[Platen 42]

As illustrated in FIG. 2, the platen 42 defines a part of the conveying passage 65 and is positioned between the conveying roller pair 59 and the discharging roller pair 44. The platen 42 faces the recording portion 24 in the upward/downward direction, and is adapted to support a sheet 12 on the conveying passage 65 from below.

[Recording Portion 24]

As illustrated in FIG. 2, the recording portion 24 is disposed in the conveying passage 65 at a position between the conveying roller pair 59 and the discharging roller pair 44. The recording portion 24 faces the platen 42 and is positioned above the platen 42. The recording portion 24 includes a carriage 40 and a recording head 38. The carriage 40 is positioned above the conveying passage 65 and faces the platen 42. The carriage 40 is reciprocally movable in a scanning direction (leftward/rightward direction 9) perpendicular to the sheet conveying direction 15.

The carriage 40 is supported to the guide rail 56 and the guide rail 57 spaced apart from the guide rail 56 in the frontward/rearward direction 8. The guide rails 56, 57 are generally plate shaped extending in the frontward/rearward direction 8 and leftward/rightward direction 9. That is, the guide rails 56 and 57 extend on the horizontal plane.

Figure 3:
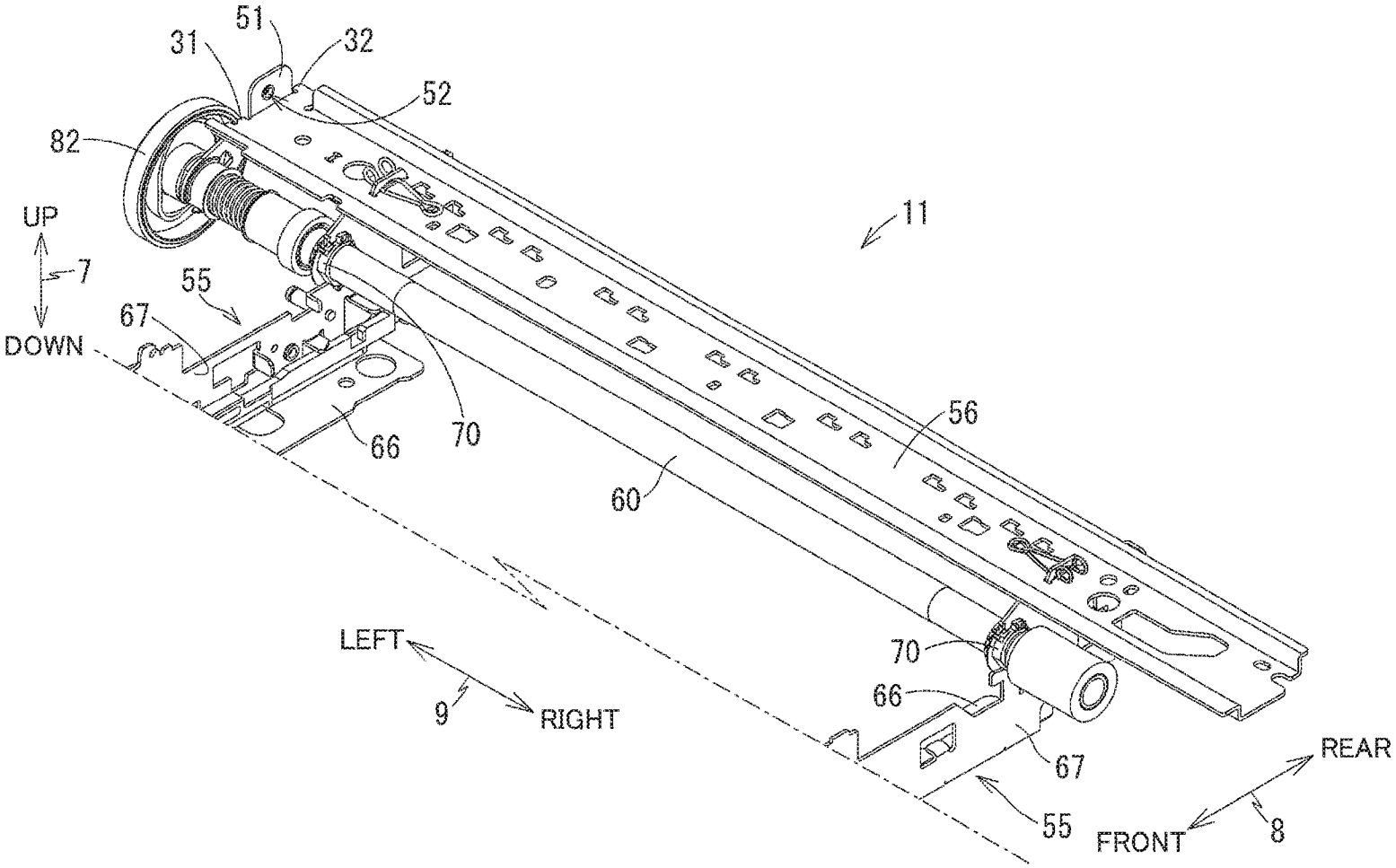
FIG. 3 is a perspective view illustrating side frames 55, a guide rail 56, a conveying roller 60, and a second gear 82 those being components of the printer portion 11.

As illustrated in FIG. 3, the guide rail 56 is provided with a protruding portion 51 that protrudes upward from a left end of the guide rail 56. A thread hole 52 is formed in the protruding portion 51.

At least one of the guide rails 56 and 57 is provided with a belt drive mechanism (not illustrated) driven by a carriage drive motor (not illustrated). The carriage 40 is connected to the belt drive mechanism, so that the carriage 40 is reciprocally movable in the leftward/rightward direction 9.

As illustrated in FIG. 2, the recording head 38 is mounted to the carriage 40. The recording head 38 has a lower surface (facing the platen 42) where a plurality of nozzles 39 are formed. The recording head 38 is connected to an ink cartridge (not illustrated) for receiving an ink from the cartridge. In the recording head 38, the nozzles 39 are adapted to eject minute ink droplets in a direction toward the platen 42 during the reciprocating motion of the carriage 40 in the leftward/rightward direction. Hence, the ink droplets are landed on the sheet 12 conveyed by the conveying roller pair 59 and supported on the platen 42 to form an image on the sheet 12.

[Side Frames 55]

As illustrated in FIGS. 3 and 4, the pair of side frames 55 are spaced apart from each other in the leftward/rightward direction 9. The pair of side frames 55 are examples of a third frame. The pair of side frames 55 are positioned outside of a sheet conveying region 100 of the conveying roller 60 in the leftward/rightward direction 9. It is noted that the conveying roller 60 conveys a sheet 12 in a state that the sheet conveying region 100 of the conveying roller 60 contacts the sheet 12.

The pair of side frames 55 are attached to and supported by the base frame. The guide rails 56, 57 (FIG. 2) are supported by and fixed to the pair of side frames 55.

The pair of side frames 55 are bilaterally symmetrical. Therefore, a side frame 55 on the right side will only be described omitting description of a side frame 55 on the left side.

As illustrated in FIG. 3, the side frame 55 on the right side includes a bottom plate 66 and a lateral plate 67. The bottom plate 66 extends in the frontward/rearward direction 8 and the leftward/rightward direction 9. That is, the bottom plate 66 extends horizontally. The bottom plate 66 is supported by the base frame from below. The lateral plate 67 upstands from a right end of the bottom plate 66. The lateral plate 67 extends in the upward/downward direction 7 and the frontward/rearward direction 8. That is, the lateral plate 67 extends vertically.

The side frame 55 has a rear portion formed with an arcuate notch (not illustrated), and a bearing 70 is fitted in the notch. The bearing 70 rotatably supports the conveying roller 60.

[Motor Support Frame 90]

Figure 7:
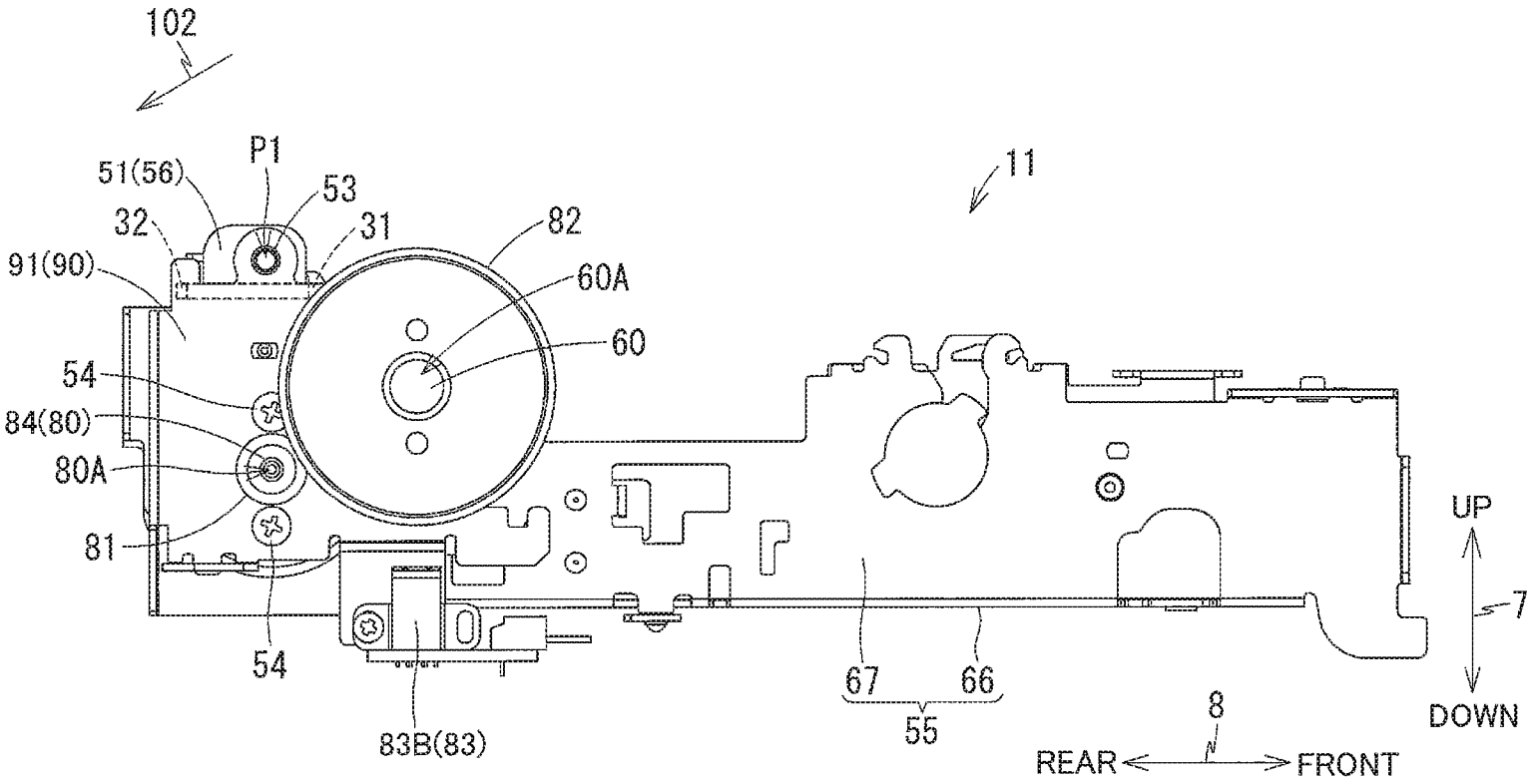
FIG. 7 is also a left side view illustrating the components illustrated in FIG. 4 from which an encoder disc 83A is removed.

The motor support frame 90 is illustrated in FIGS. 4, 5 and 7. The motor support frame 90 includes a first wall 91 as an example of a wall, a second wall 92, and a third wall 93, and is provided with a bearing 75 (as an example of a bearing). The walls 91, 92, 93 are integrally formed. The bearing 75 is attached to the first wall 91.

Figure 8:
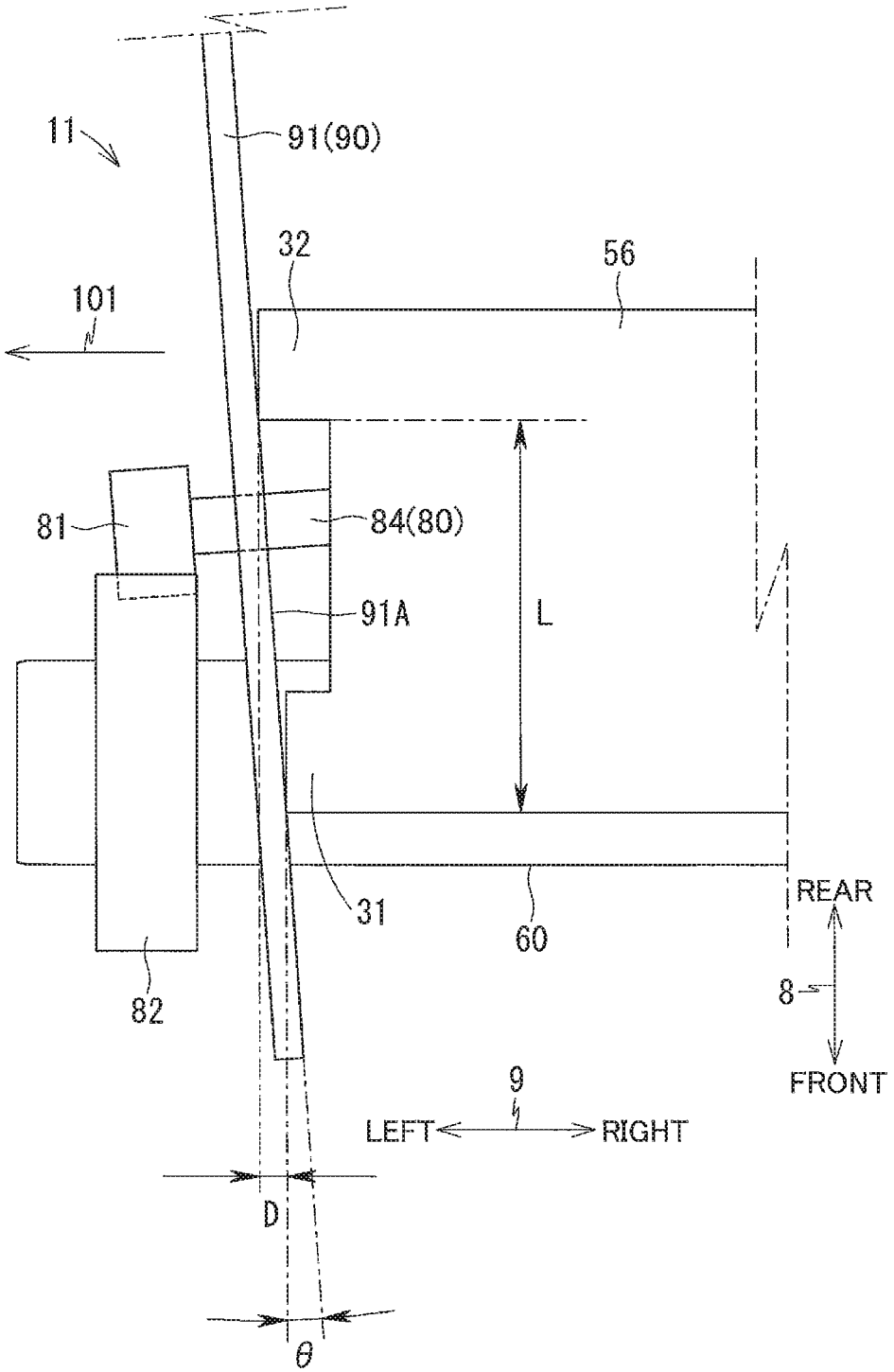
FIG. 8 is a plan view illustrating the motor support frame 90 and components surrounding the motor support frame 90 in the printer portion 11.

As illustrated in FIGS. 7 and 8, the first wall 91 is plate shaped extending in the upward/downward direction 7 and substantially in the frontward/rearward direction 8. More specifically, the first wall 91 extends in the upward/downward direction 7 and in a direction slightly inclined from the frontward/rearward direction 8 such that the rear end of the first wall 91 is positioned slightly leftward relative to the front end of the first wall 91. The first wall 91 supports a left end portion of the conveyer motor 80. The first wall 91 is positioned leftward of the guide rail 56. As illustrated in FIG. 4, the first wall 91 has a right surface 91A (as an example of a side surface) facing the guide rail 56 in the leftward/rightward direction 9.

As illustrated in FIG. 5, the second wall 92 is plate shaped extending in the upward/downward direction 7 and substantially in the frontward/rearward direction 8. More specifically, the second wall 92 extends in the upward/downward direction 7 and in a direction slightly inclined from the frontward/rearward direction 8 such that the rear end of the second wall 92 is positioned slightly leftward relative to the front end of the second wall 92. The second wall 92 is positioned rightward of the first wall 91, and supports a right end portion of the conveyer motor 80.

As illustrated in FIG. 4, the third wall 93 is plate shaped extending in the upward/downward direction 7 and substantially in the leftward/rightward direction 9. More specifically, the third wall 93 extends in the upward/downward direction 7 and in a direction slightly inclined from the leftward/rightward direction 9 such that the left end of the third wall 93 is positioned slightly frontward relative to the right end of the third wall 93. The third wall 93 has a left end connected to a rear end of the first wall 91, and has a right end connected to a rear end of the second wall 92.

The first wall 91 is formed with three thread holes (not illustrated) and a single through-hole (not illustrated).

An uppermost thread hole among the three thread holes has a diameter equal to that of the thread hole 52 (FIG. 3) formed in the protruding portion 51 of the guide rail 56. As illustrated in FIG. 7, a male thread 53 is threadingly engaged with the uppermost thread hole and the thread hole 52 of the guide rail 56. Thus, the first wall 91 is fastened to and fixed to the guide rail 56.

Male threads 54 are threadingly engaged with remaining two thread holes and female threads (not illustrated) formed in the conveyer motor 80. Thus, the conveyer motor 80 is fixed to the first wall 91 such that the shaft 84 of the conveyer motor 80 extends perpendicularly to the first wall 91.

The shaft 84 of the conveyer motor 80 extends through the through-hole of the first wall 91. The motor body of the conveyer motor 80 is positioned rightward of the first wall 91. The first gear 81 coupled to the tip end portion of the shaft 84 is positioned leftward of the first wall 91.

The first wall 91 is formed with an arcuate notch at a position frontward of the three thread holes. As illustrated in FIGS. 4 and 5, the bearing 75 is fitted in the notch of the first wall 91. The conveying roller 60 is inserted through the bearing 75 such that the conveying roller 60 is rotatably supported by the bearing 75. The bearing 75 is fitted in the notch of the first wall 91 such that the conveying roller 60 supported by the bearing 75 maintains its orientation extending in the leftward/rightward direction 9, even though the first wall 91 is slightly inclined from the frontward/rearward direction 9. That is, the motor support frame 90 supports the conveying roller 60 such that the conveying roller 60 extends in the leftward/rightward direction 9, even though the first wall 91 of the motor support frame 90 is slightly inclined from the frontward/rearward direction 9.

As illustrated in FIG. 4, the second wall 92 has an upper end provided with an engaging portion 92A. The guide rail 56 is formed with a through-hole 56A with which the engaging portion 92A is engaged. Thus, the second wall 92 is engaged with the guide rail 56. The motor support frame 90 is supported to the guide rail 56 by both of the engagement between the second wall 92 and the guide rail 56 and the fixed connection between the first wall 91 and the guide rail 56.

[First Abutment Portion 31 and Second Abutment Portion 32]

As illustrated in FIG. 4, a first direction 101 is defined along the leftward/rightward direction 9, and is directed from right to left. In other words, the first direction 101 is along the leftward/rightward direction 9 and is directed from the sheet conveying region 100 of the conveying roller 60 to the second gear 82. The guide rail 56 is disposed to the right of the first wall 91 of the motor support frame 91. In other words, the guide rail 56 is disposed upstream of the first wall 91 of the motor support frame 90 in the first direction. The guide rail 56 is integrally provided with a first abutment portion 31 and a second abutment portion 32 such that the first abutment portion 31 and the second abutment portion 32 protrude from a left end of the guide rail 56 leftwardly, that is, in the first direction 101. The first abutment portion 31 and the second abutment portion 32 are disposed apart from each other in the frontward/rearward direction 8. The second abutment portion 32 is disposed rearward of the first abutment portion 31. The guide rail 56 is disposed rightward of the first wall 91 of the motor support frame 90 such that the first abutment portion 31 and the second abutment portion 32 are in abutment with the right surface 91A of the first wall 91 of the motor support frame 90 from the right side. That is, the guide rail 56 is disposed upstream of the first wall 91 in the first direction 101, with the first abutment portion 31 and the second abutment portion 32 being in abutment with the right surface 91A of the first wall 91 from an upstream side in the first direction.

As illustrated in FIG. 7, an axis 60A of the conveying roller 60 is an imaginary line that passes through a diametrical center of the conveying roller 60. In the present embodiment, the axis 60A of the conveying roller 60 extends on the horizontal plane and in the leftward/rightward direction 9. An axis 80A of the conveyer motor 80 is an imaginary line that passes through a diametrical center of the shaft 84 of the conveyer motor 80. In the present embodiment, the axis 80A of the conveyer motor 80 extends in a direction that is on the horizontal plane, but is slightly inclined from the leftward/rightward direction 9 such that the left end of the axis 80A is positioned slightly frontward relative to the right end of the axis 80A. A second direction 102 is defined as a direction that is perpendicular to the leftward/rightward direction 9 (axis 60A of the conveying roller 60) and is directed from the axis 60A of the conveying roller 60 to the axis 80A of the conveyer motor 80. In the present embodiment, the second abutment portion 32 is positioned downstream of the first abutment portion 31 in the second direction 102.

A fastening position P1 between the first wall 91 and the guide rail 56 is positioned downstream of the first abutment portion 31 in the second direction 102 and upstream of the second abutment portion 32 in the second direction 102. In other words, the fastening position P1 is positioned between the first abutment portion 31 and the second abutment portion 32 in the second direction 102. Here, the fastening position P1 is at a diametrical center of the uppermost thread hole formed in the first wall 91, or at a diametrical center of the thread hole 52 of the guide rail 56, or at a diametrical center of the male thread 53 threadingly engaged with the thread hole 52. Apparently, these diametrical centers are coincident with each other.

As illustrated in FIG. 8, an abutment position between the second abutment portion 32 and the right surface 91A of the first wall 91 is leftward of an abutment position between the first abutment portion 31 and the right surface 91A. In other words, the abutment position between the second abutment portion 32 and the right surface 91A of the first wall 91 is downstream of the abutment position between the first abutment portion 31 and the right surface 91A of the first wall 91 in the first direction 101. That is, the second abutment portion 32 protrudes from the guide rail 56 further leftward than the first abutment portion 31 protrudes from the guide rail 56. Accordingly, by the abutment of the first abutment portion 31 and the second abutment portion 32 with the right surface 91A of the first wall 91 from right side, the first wall 91 is inclined relative to the frontward/rearward direction 8 such that a rear portion of the first wall 91 is positioned leftward of a front portion of the first wall 91. The first wall 91 extends in the upward/downward direction 7 because the guide rail 56 extends on the horizontal plane, with the first abutment portion 31 and the second abutment portion 32 being on the same vertical level. Because the first wall 91 of the motor support frame 90 is thus inclined relative to the frontward/rearward direction 8, the second wall 92 and the third wall 93 of the motor support frame 90 are also inclined relative to the frontward/rearward direction 8 and the leftward/rightward direction 9 as described above. Similarly, because the first wall 91 is inclined relative to the frontward/rearward direction 8 such that the rear of the first wall 91 is leftward relative to the front of the first wall 91, the shaft 84 of the motor 80 is inclined relative to the leftward/rightward direction 9 such that the left end of the shaft 84 is frontward relative to the rear end of the shaft 84, thereby narrowing the pitch between the first gear 81 and the second gear 82 as also described above.

Here, the inclination of the first wall 91 cannot be recognized in FIG. 4, since a distance D in the leftward/rightward direction 9 from the abutment position between the first abutment portion 31 and the right surface 91A of the first wall 91 to the abutment position between the second abutment portion 32 and the right surface 91A of the first wall 91 is extremely smaller than lengths in the leftward/rightward direction 9 of the guide rail 56 and the motor support frame 90. In FIG. 8, the distance D is delineated in exaggerated fashion.

As shown in FIG. 8, a length L is defined in the frontward/rearward direction 8 from the abutment position between the first abutment portion 31 and the right surface 91A of the first wall 91 to the abutment position between the second abutment portion 32 and the right surface 91A of the first wall 91. An inclination angle θ is defined as an angle of an imaginary line connecting the abutment position between the first abutment portion 31 and the right surface 91A of the first wall 91 to the abutment position between the second abutment portion 32 and the right surface 91A of the first wall 91 with respect to the frontward/rearward direction 8. The inclination angle θ is determined by converting the size of the distance D relative to the length L into an angular value, and indicates how the first wall 91 is inclined relative to the frontward/rearward direction 8.

According to the present embodiment, the distance D is set to an optimum value relative to the length L, in order that the pitch between the first gear 81 and the second gear 82 is set to such an optimum value that can optimize the backlash amount between the first gear 81 and the second gear 82. In other words, the inclination angle θ of the first wall 91 is set to an optimum value relative to the frontward/rearward direction 8, in order to optimize the pitch between the first gear 81 and the second gear 82. It is noted that the pitch between the first gear 81 and the second gear 82 will change by a relatively small amount when the distance D is changed by a relatively large amount. Accordingly, by setting the distance D to the optimum value, the pitch between the first gear 81 and the second gear 82 can be set to the optimum value with high precision. The backlash amount between the first gear 81 and the second gear 82 can therefore be set to the optimum value with high precision.

Example

Next will be described a concrete example of the multi-function apparatus 10, in which the length L is equal to 20 [mm] and the optimum backlash amount between the first gear 81 and the second gear 82 is equal to 1 [enc]. It is noted that the backlash amount being equal to 1 [enc] means that only one pulse signal is outputted from the optical sensor 83B during a period after the first gear 81 stops rotating and until the second gear 82 finally stops rotating. An experiment was conducted to the multi-function apparatus 10 of this example, in order to know the optimum distance D that can optimize the backlash amount. During the experiment, the distance D was changed to various values in the range of 0 [mm] to 0.5 [mm]. The backlash amount was detected by using the rotary encoder 83. The experimental results show that when the distance D was set to 0.5 [mm], the backlash amount between the first gear 81 and the second gear 82 became equal to the optimum value of 1 [enc]. It is noted that the inclination angle θ was equal to 1.4 [degrees] when the distance D was set to 0.5 [mm] with respect to the length L of 20 [mm]. The experimental results therefore show that the optimum distance D is equal to 0.5 [mm] and the optimum inclination angle θ is equal to 1.4 [degrees].

Figure 10A:
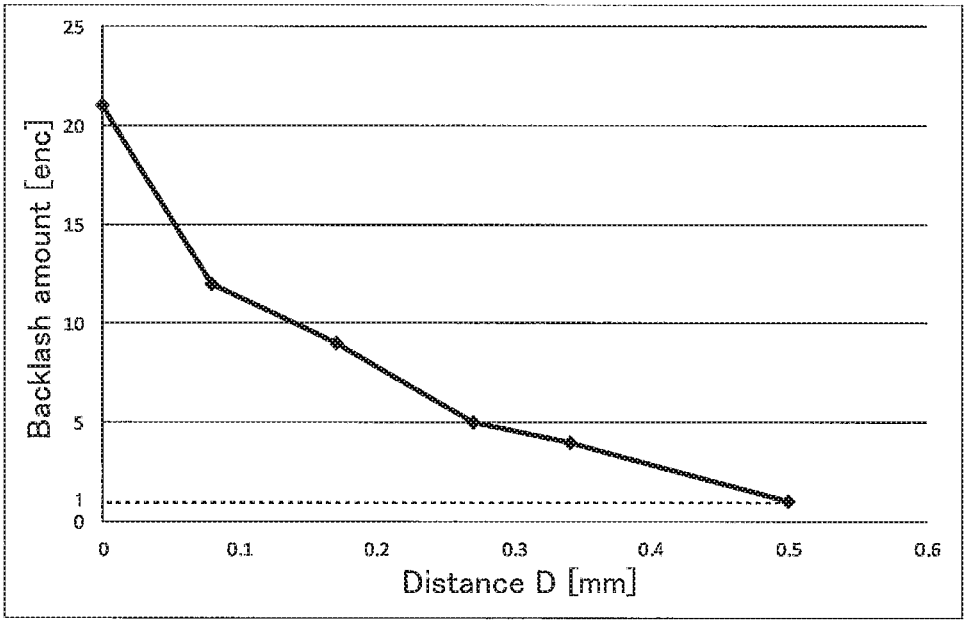
FIG. 10A is a graphical representation illustrating relationship between a distance D and an amount of backlash between the first gear 81 and the second gear 82.

Details in the experimental results are shown in FIG. 10A. The graph in FIG. 10A shows how the backlash amount (enc) between the first gear 81 and the second gear 82 changed in accordance with the change in the distance D (mm) relative to the distance L of 20 mm.

Figure 10B:
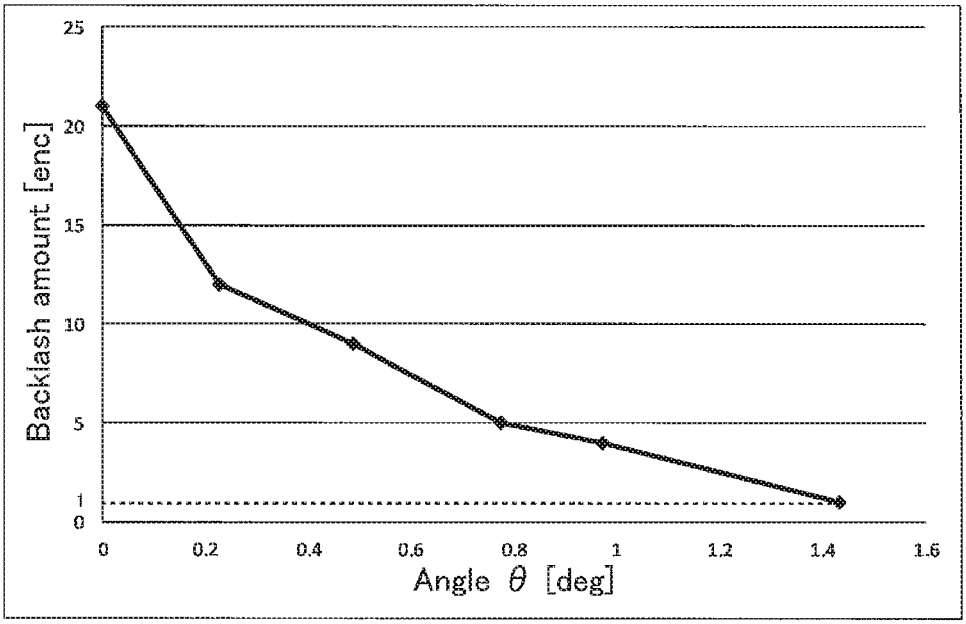
FIG. 10B is a graphical representation illustrating relationship between an inclination angle θ and the amount of backlash between the first gear 81 and the second gear 82.

A graph represented in FIG. 10B shows a relationship between the inclination angle θ (deg) and the backlash amount (enc) between the first gear 81 and the second gear 82 in the experiment. The inclination angle θ was determined dependently on the distance D and the length L of 20 [mm]. It is apparent from FIGS. 10A and 10B that the backlash amount between the first gear 81 and the second gear 82 can be adjusted to the optimum value of 1 [enc] by setting the distance D to 0.5 [mm], that is, by setting the inclination angle θ to 1.4 [degrees]. In other words, in order to set the backlash amount to the optimum value of 1 [enc] in the case where the length L is equal to 20 [mm], the distance D should preferably be set to 0.5 [mm] and the inclination angle θ should preferably be set to 1.4 [degrees]. In addition, according to the present embodiment, the backlash amount between the first gear 81 and the second gear 82 can be adjusted to the optimum value of 1 [enc] highly precisely because the pitch between the first gear 81 and the second gear 82 can be adjusted highly precisely by adjusting the distance D.

In the above-described example where the length L is equal to 20 mm, the optimum distance D is equal to 0.5 mm, and the optimum inclination angle θ is equal to 1.4 degrees. However, the optimum distance D and optimum inclination angle θ are changed in accordance with the change in the length L. Accordingly, the distance D is not limited to 0.5 mm, but other values such as 0.4 mm are available. Similarly, the inclination angle θ is not limited to 1.4 degrees, but other values such as 1.0 degree are available.

Advantages

According to the above-described embodiment, the first abutment portion 31 and the second abutment portion 32 are in abutment with the right surface 91A of the first wall 91 of the motor support frame 90. In this case, the abutment position between the second abutment portion 32 and the right surface 91A is leftward of the abutment position between the first abutment portion 31 and the right surface 91A. Therefore, the right surface 91A of the first wall 91 is not perpendicular to the leftward/rightward direction 9. Specifically, the right surface 91A of the first wall 91 is inclined, with respect to an imaginary plane that is directed perpendicular to the leftward/rightward direction 9, such that the rear portion of the right surface 91A is positioned leftward of the front portion of the right surface 91A. Here, the first wall 91 is the part of the motor support frame 90, and the motor support frame 90 supports the conveyer motor 80, and the first gear 81 is attached to the conveyer motor 80. Hence, the first gear 81 is also inclined with respect to the imaginary plane because of the inclination of the right surface 91A of the first wall 91 with respect to the imaginary plane. On the other hand, the conveying roller 60 is supported by the motor support frame 90 via the bearing 75 so that the axis of the conveying roller 60 is not inclined with respect to the leftward/rightward direction 9, even though the first wall 91 of the motor support frame 90 is inclined with respect to the imaginary plane. Accordingly, inclining the first gear 81 narrows the pitch between the first gear 81 and the second gear 82. In other word, the distance between the center of the first gear 81 and the center of the second gear 82 is decreased.

As described above, when the pitch between the first gear 81 and the second gear 82 is too large, the backlash amount will increase and become greater than the optimum value by an excessive amount, resulting in that the conveying roller 60 will convey the sheet 12 with low precision. On the other hand, if the pitch between the first gear 81 and the second gear 82 is too small, the backlash amount will decrease and become smaller than the optimum value by an excessive amount, resulting in that excessive load is imparted on the gears and abnormal sound may be generated during rotation of the gears. In this connection, precise adjustment on the pitch between the first gear 81 and the second gear 82 is required. According to the above-described embodiment, adjustment of the abutment position between the second abutment portion 32 and the right surface 91A of the first wall 91 can provide inclination of the first gear 81 to adjust the pitch between the first gear 81 and the second gear 82. In addition, it is possible to adjust the pitch between the first gear 81 and the second gear 82 by a relatively small amount by adjusting the abutment position between the second abutment portion 32 and the right surface 91A of the first wall 91 in the leftward/rightward direction 9 by a relatively large amount. Consequently, the pitch between the first gear 81 and the second gear 82 can be adjusted with high precision. Accordingly, it is possible to decrease the deviation of the backlash amount between the first gear 81 and the second gear 82 from the optimum value. In other word, the backlash amount can be adjusted to the optimum value highly precisely.

Further, it is desirable that the conveying roller 60 equipped with the rotary encoder 83 should be rotated with high accuracy. According to the present embodiment, by reducing the variation of the backlash between the first gear 81 and the second gear 82 from the optimum value, it is possible to rotate the conveying roller 60 highly precisely.

Further, according to the above-described embodiment, the conveying roller 60 is fixed in position by the guide rail 56 through the side frames 55. Further, the conveyer motor 80 is fixed in position by the guide rail 56 through the motor support frame 90. That is, both the conveying roller 60 and the conveyer motor 80 are subjected to positioning by the guide rail 56. Therefore, positional accuracy between the conveying roller 60 and the conveyer motor 80 can be improved.

Further, according to the above-described embodiment, both of the conveying roller 60 and the conveyer motor 80 are supported by the motor support frame 90. Therefore, positional accuracy between the conveying roller 60 and the conveyer motor 80 can be improved.

Further, according to the above-described embodiment, the guide rail 56 provided with the first abutment portion 31 and the second abutment portion 32 is fastened with the motor support frame 90 having the right surface 91A at a position between the abutment position between the first abutment portion 31 and the right surface 91A and the abutment position between the second abutment portion 32 and the right surface 91A. Therefore, these abutment positions can be stabilized.

Further, according to the above-described embodiment, the guide rail 56 supports the recording portion 24, the first abutment portion 31 and the second abutment portion 32 provided to the guide rail 56 are in abutment with the right surface 91A of the motor support frame 90, the motor support frame 90 supports the conveyer motor 80, and the first gear 81 is attached to the conveyer motor 80. Therefore, positioning accuracy among the recording portion 24, the conveyer motor 80, and the first gear 81 can be improved.

Modification

Figure 9:
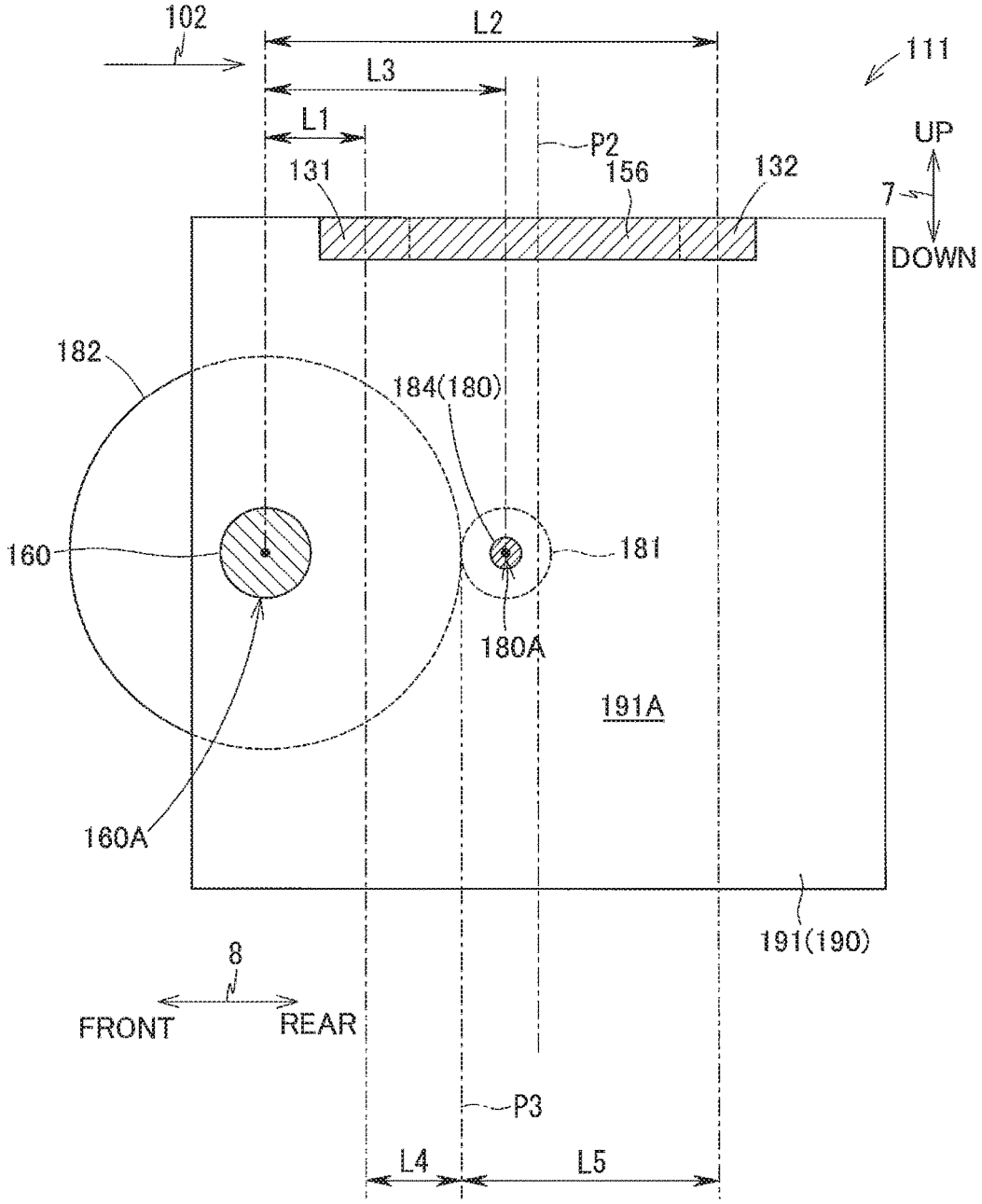
FIG. 9 is a cross-sectional view taken along a plane extending in both of a vertical direction 7 and a frontward/rearward direction 8 and schematically illustrating a first wall 191 of a motor support frame 190, a guide rail 156, a conveyer roller 160, a shaft 184 of a motor 180, a first gear 181, and a second gear 182 according to a modification.

It should be noted that, in a modification, as illustrated in FIG. 9, those components that are identical with or corresponding to the components in the above-described embodiment are assigned with such reference numerals that are obtained by adding a hundred to the original reference numerals in the embodiment, respectively, and duplicated descriptions are omitted.

In the above-described embodiment, the axis 80A of the conveyer motor 80 is positioned rearward of and below the axis 60A of the conveying roller 60 as illustrated in FIG. 7. However, other positional relationship between the axes 80A and 60A is conceivable. For example, the axis 80A of the conveyer motor 80 may be positioned frontward of and above the axis 60A of the conveying roller 60. Alternatively, the axis 80A may be positioned exactly below or exactly rearward of the axis 60A. The second direction 102 becomes different from the direction indicated in FIG. 7 in accordance with the change in positional relationship between the axis 80A of the conveyer motor 80 and the axis 60A of the conveying roller 60. Incidentally, in the modification illustrated in FIG. 9, an axis 180A of a conveyer motor 180 is positioned exactly rearward of an axis 160A of a conveying roller 160. In this case, the second direction 102 is along the frontward/rearward direction 8 and is directed from the front to the rear.

As illustrated in FIG. 9, the first abutment portion 131 is in abutment with an upstream portion of the right surface 191A of the first wall 191 of the motor support frame 190, wherein the upstream portion of the right surface 191A of the first wall 191 is part of the right surface 191A of the first wall 191 that is positioned upstream of a center P2 in the second direction 102 of the right surface 191A of the first wall 191. Further, the second abutment portion 132 is in abutment with a downstream portion of the right surface 191 of the first wall 191, wherein the downstream portion of the right surface 191A of the first wall 191 is part of the right surface 191A of the first wall 191 that is positioned downstream of the center P2 in the second direction 102 of the right surface 191A of the first wall 191. A distance between the first abutment portion 131 and the second abutment portion 132 in the second direction 102 is preferably as large as possible. In other words, the first abutment portion 131 is preferably in abutment with an upstream end portion of the right surface 191A of the first wall 191 in the second direction 102, and the second abutment portion 132 is preferably in abutment with a downstream end portion of the right surface 191A of the first wall 191 in the second direction 102.

With such an arrangement, the first abutment portion 131 and the second abutment portion 132 are in abutment with the first wall 191 of the first wall 191, with the center P2 of the right surface 191A of the first wall 191 in the second direction 102 being positioned between the first abutment portion 131 and the second abutment portion 132. As a result, the first wall 191 can be positioned highly stably.

Further, as illustrated in FIG. 9, a distance L1 between the first abutment portion 131 and the axis 160A of the conveying roller 160 in the second direction 102 is smaller than a distance L3 between the axis 180A of the conveyer motor 180 and the axis 160A of the conveying roller 160 in the second direction 102. A distance L2 between the second abutment portion 132 and the axis 160A of the conveying roller 160 in the second direction 102 is greater than the distance L3 in the second direction 102.

With such an arrangement, the first abutment portion 131 and the second abutment portion 132 are in abutment with the right surface 191A of the first wall 191 of the motor support frame 190, with the axis 180A of the conveyer motor 180 being positioned between the first abutment portion 131 and the second abutment portion 132 in the second direction 102. Therefore, the motor support frame 190 can be positioned stably, even though the motor support frame 190 is inclined with respect to the imaginary plane due to the abutment of the motor support frame 190 with the first abutment portion 131 and the second abutment portion 132.

As illustrated in FIG. 9, a distance L4 from the first abutment portion 131 to a meshing engagement position P3 between the first gear 181 and the second gear 182 in the second direction 102 is smaller than a distance L5 from the first abutment portion 131 to the meshing engagement position P3 in the second direction 102.

With such an arrangement, the abutment position between the first abutment portion 131 and the right surface 191A of the first wall 191 serves as a fulcrum position of the right surface 191A of the first wall 191 relative to the imaginary plane. Because the fulcrum position is relatively close to the meshing engagement position P3, the pitch between the first gear 181 and the second gear 182 will change by a relatively small amount when the inclination angle of the right surface 191A of the first wall 191 is changed by a relatively large amount. Accordingly, the pitch between the first gear 181 and the second gear 182 can be adjusted by a relatively small amount through adjusting the inclination angle of the right surface 191A of the first wall 191 by a relatively large amount. In other words, the pitch between the first gear 181 and the second gear 182 can be adjusted with high precision.

In the above-described embodiment, the first direction 101 is along the leftward/rightward direction 9 and is directed from right to left. However, the first direction 101 can be along the leftward/rightward direction 9 and directed from left to right. In the latter case, the first abutment portion 31 and the second abutment portion 32 are in abutment with the first wall 91 of the motor support frame 90 from left side. That is, structures of the guide rail 56 and the motor support frame 90 and their relative positions are different from those in the above-described embodiment.

In the above-described embodiment, the conveying roller 60, the pinch roller 61, the discharge roller 62, and the spur 63 are rotatable about their axes extending in the leftward/rightward direction 9. That is, the leftward/rightward direction 9 is the example of the axial direction of the conveying roller 60. The conveyer motor 80 is rotatable about its axis extending in a direction that is slightly inclined relative to the leftward/rightward direction 9. However, the axes of the conveying roller 60, the pinch roller 61, the discharge roller 62, and the spur 63 may extend in a direction other than the leftward/rightward direction 9. In the latter case, the direction other than the leftward/rightward direction 9 is the example of the axial direction of the roller 60. The axis of the motor 80 is slightly inclined relating to the axial direction of the conveying roller 60.

In the above-described embodiment, the motor support frame 90 is supported by the guide rail 56. However, the motor support frame 90 can be supported to a member other than the guide rail 56, such as the guide rail 57 or the base frame.

In the above-described embodiment, each of the guide rails 56 and 57 is supported by the side frames 55. However, each of the guide rails 56 and 57 can be supported by a member other than the side frames 55, such as the base frame instead of the side frame 55.

In the above-described embodiment, the conveying roller 60 is supported by the bearings 70 and the bearing 75. That is, the conveying roller 60 is supported to the side frames 55 and the motor support frame 90. However, the motor support frame 90 is not necessarily provided with the bearing 75. That is, the motor support frame 90 does not necessarily support the conveying roller 60. In the latter case, the conveying roller 60 may be supported by the side frames 55 only.

In the above-described embodiment, the guide rail 56 is the example of the second frame. However, instead of the guide rail 56, the guide rail 57 and the base frame can be examples of the second frame.

In the above-described embodiment, the conveying device is provided in the printer portion 11. However, the conveying device can be provided in a device other than the printer portion 11, such as a scanner device.

While the description has been made in detail with reference to the embodiments thereof, it would be apparent to those skilled in the art that many modifications and variations may be made therein without departing from the spirit of the disclosure.

What is claimed is:

1. A sheet conveying device comprising:

a motor;

a first gear attached to the motor such that the first gear is rotatable together with the motor and coaxially with the motor;

a roller configured to be rotated to convey a sheet, the roller extending in an axial direction;

a second gear attached to the roller such that the second gear is rotatable together with the roller and coaxially with the roller, the second gear being in meshing engagement with the first gear;

a first frame supporting the motor; and a second frame extending in the axial direction of the roller, the first frame including a wall having a side surface in confrontation with the second frame in the axial direction of the roller, wherein the wall of the first frame is disposed downstream of the second frame in a first direction along the axial direction of the roller, wherein an axis of the roller is located upstream of an axis of the motor in a second direction that is perpendicular to the axial direction of the roller, wherein the second frame is provided with:

a first abutment portion positioned upstream of the wall of the first frame in the first direction and in abutment with the side surface of the wall; and a second abutment portion positioned upstream of the wall of the first frame in the first direction and in abutment with the side surface of the wall, the second abutment portion being positioned downstream of the first abutment portion in the second direction, and wherein an abutment position between the second abutment portion and the side surface of the wall of the first frame is positioned downstream in the first direction of an abutment position between the first abutment portion and the side surface of the wall of the first frame.

2. The sheet conveying device according to claim 1, wherein the wall of the first frame is inclined relative to both of the axial direction and the second direction, the axis of the motor being inclined relative to the axial direction of the roller.

3. The sheet conveying device according to claim 1, wherein the first abutment portion is in abutment with an upstream portion of the side surface of the wall of the first frame, the upstream portion being upstream of a center of the side surface of the wall of the first frame in the second direction, and wherein the second abutment portion is in abutment with a downstream portion of the side surface of the wall of the first frame, the downstream portion being downstream of the center of the side surface of the wall of the first frame in the second direction.

4. The sheet conveying device according to claim 3, wherein a distance between the axis of the roller and the first abutment portion in the second direction is smaller than a distance between the axis of the roller and the axis of the motor in the second direction, and wherein a distance between the axis of the roller and the second abutment portion in the second direction is greater than the distance between the axis of the roller and the axis of the motor in the second direction.

5. The sheet conveying device according to claim 3, wherein a distance between the first abutment portion and a meshing engagement position between the first gear and the second gear in the second direction is smaller than a distance between the second abutment portion and the meshing engagement position in the second direction.

6. The sheet conveying device according to claim 1, wherein the roller has a sheet conveying region at which the roller conveys the sheet, the second gear being disposed downstream of the sheet conveying region of the roller in the first direction, and wherein the second abutment portion protrudes in the first direction from the second frame by a protruding amount greater than a protruding amount by which the first abutment portion protrudes from the second frame.

7. The sheet conveying device according to claim 1, further comprising a rotary encoder configured to output a pulse signal indicative of a rotation amount of the roller.

8. The sheet conveying device according to claim 1, wherein the second frame supports the first frame.

9. The sheet conveying device according to claim 8, further comprising a third frame supporting both of the roller and the second frame.

10. The sheet conveying device according to claim 8, wherein the first frame is provided with a bearing supporting the roller.

11. The sheet conveying device according to claim 1, wherein the wall of the first frame is fastened to the second frame at a fastening position that is positioned between the first abutment portion and the second abutment portion in the second direction.

12. An image recording apparatus comprising:

the sheet conveying device according to claim 1; and a recording head configured to record an image on the sheet conveyed by the roller of the sheet conveying device.

13. The image recording apparatus according to claim 12, wherein the wall of the first frame is inclined relative to both of the axial direction and the second direction, the axis of the motor being inclined relative to the axial direction of the roller.

14. The image recording apparatus according to claim 12, wherein the second frame supports the recording head.

* * * * *